US005553583A

United States Patent [19]

Jones

[11] Patent Number: 5,553,583

[45] Date of Patent: Sep. 10, 1996

[54] ROCKER ARM LUBRICATION ARRANGEMENT

[75] Inventor: Derek Jones, Pontesbury, Great Britain

[73] Assignee: Perkins Limited, Cambridgeshire, Great Britain

[21] Appl. No.: 379,706

[22] Filed: Jan. 27, 1995

[30] Foreign Application Priority Data

Jan. 28, 1994 [GB] United Kingdom ..... 9401645

[51] Int. Cl.[6] ..... F01M 9/10

[52] U.S. Cl. ..... 123/90.34; 123/90.36; 123/90.38

[58] Field of Search ..... 123/90.33, 90.34, 123/90.36, 90.38, 90.39, 196 M, 198 E, 195 C; 184/6.5, 6.9

[56] References Cited

U.S. PATENT DOCUMENTS

| | | | |
|---|---|---|---|
| 2,522,326 | 9/1950 | Winter, Jr. | 123/90.36 |
| 2,607,331 | 8/1952 | Wefing | 123/90.38 |
| 2,650,579 | 9/1953 | Bernight | 123/90.36 |
| 3,628,513 | 12/1971 | Grosseau | 123/90.36 |
| 4,343,270 | 8/1982 | Kawabe | 123/90.34 |
| 4,539,952 | 9/1985 | Nouno et al. | 123/90.36 |
| 4,662,323 | 5/1987 | Moriya | 123/90.36 |
| 4,715,335 | 12/1987 | Elsbett et al. | 123/41.35 |
| 4,784,095 | 11/1988 | Golding et al. | 123/90.41 |
| 5,285,754 | 2/1994 | Bell | 123/90.38 |

FOREIGN PATENT DOCUMENTS

| | | | |
|---|---|---|---|
| 0211503A1 | 2/1987 | European Pat. Off. . | |
| 549594 | 2/1923 | France . | |
| 852336 | 1/1940 | France | 123/90.36 |
| 2304772 | 10/1976 | France . | |
| 223393 | 10/1923 | United Kingdom . | |
| 528997 | 11/1940 | United Kingdom . | |
| 600092 | 3/1948 | United Kingdom . | |
| 667791 | 3/1952 | United Kingdom . | |
| 709820 | 6/1954 | United Kingdom . | |
| 998350 | 7/1965 | United Kingdom . | |
| 2159877 | 12/1985 | United Kingdom . | |
| 2236356 | 4/1991 | United Kingdom . | |

*Primary Examiner*—Weilun Lo
*Attorney, Agent, or Firm*—Nilles & Nilles, S.C.

[57] ABSTRACT

A rocker arm lubrication arrangement for an engine includes a shaft which pivotally mounts a number of rocker arms. The shaft has a longitudinally extending lubricant supply bore and radially upwardly extending supply bores corresponding to positions of the rocker arms. Lubricant passes along the longitudinally extending supply bore to the radially extending bores and then exits via corresponding bores in the rocker arms. The lubricant is under pressure and thus exits as jets of lubricant which impinge on an underside of an engine cover to be returned as a lubricant spray. The rocker arms may be arranged on the shaft such that the jets are intermittent.

21 Claims, 4 Drawing Sheets

ROCKER ARM LUBRICATION ARRANGEMENT

BACKGROUND OF THE INVENTION

1. Field of the Invention

The present invention relates to an improved rocker lubrication arrangement which is intended particularly, but not exclusively, for use in an internal combustion (i.c.) engine.

2. Discussion of the Related Art

Lubrication of a rocker arm assembly can be by means of an oil mist generated within an engine housing. The oil mist coats engine components lubricating any surfaces of contact between them. The mist may not reach into the upper regions of the housing below the engine cover. This can result in the metal to metal contacts at both ends of the rocker arms remaining dry leading to excessive wear and the need for frequent readjustment and replacement of parts.

One solution to this problem has been to drill oil channels laterally through the bosses of the rocker arms. The channels each communicate at first ends with an oil supply passage in the rocker arm support shaft, which normally provides a supply of oil to lubricate rocker arm bushes, and each exit at second ends at appropriate points on the rocker arm bodies to supply oil to the push rod ball joints and rocker arm ends contacting valve stem assemblies. This solution is expensive since the rocker arms are often formed of cast or forged metal and drilling of this material is difficult, particularly bearing in mind the narrow diameters of the drilled channels compared to their relatively long lengths. There is considerable wastage of rocker arms during the machining process due to broken drill bits, for example.

A further problem is that the casting or forging tolerances must be closely controlled to ensure that the drilled holes run centrally down the bosses.

OBJECTS AND SUMMARY OF THE INVENTION

It is an object of the present invention to obviate or mitigate the aforesaid problems and reduce machining time and hence cost.

According to one aspect of the present invention there is provided a rocker arm lubrication arrangement comprising a rocker arm assembly consisting of a number of rocker arms mounted for pivotal movement about a longitudinally extending support shaft formed with a longitudinally extending lubricant supply bore and a number of radially upwardly extending lubricant supply bores communicating therewith, wherein at least one of said radially upwardly extending bores communicates with an upwardly extending lubricant supply bore in a corresponding one of said rocker arms such that lubricant passing under pressure through the longitudinally extending supply bore to said upwardly extending supply bore forms a jet of lubricant which rises through the corresponding bore in the rocker arm to impinge upon an underside of an engine cover to be returned as a spray to lubricate the contact between an end of the rocker arm and a component.

Preferably, each upwardly extending supply bore in the support shaft has a portion of narrower diameter than the longitudinally extending supply bore.

Preferably also, at least one deflector member is formed integrally with or attached to the underside of the engine cover to direct the spray.

Preferably also, the lubricant jet rising from the rocker arm is not continuous.

Preferably further, the relative diameter of an upwardly extending supply bore in the shaft to the diameter of a corresponding supply bore in a rocker arm is such that pivotal movement of the rocker arm causes the respective supply bores to become radially displaced to the extent of cutting off lubricant flow for a portion of a period of oscillation of pivotal movement of the rocker arm.

According to a second aspect of the present invention, there is provided a method of lubricating a rocker arm assembly wherein lubricant is supplied under pressure along a longitudinally extending bore formed in a rocker arm support shaft and diverted upwardly through communicating upwardly directed bores in the shaft and corresponding bores in rocker arms pivotally mounted thereon.

Preferably, the method includes the step of supplying the lubricant at a pressure sufficient to cause the lubricant to form jets rising from the upwardly directed bores in the support shaft through corresponding bores in the rocker arms, wherein said jets impinge upon the underside of an engine cover to be returned as a spray which lubricates the rocker arm assembly.

Preferably also, the method includes the step of directing the jets such that they impinge on at least one deflector member located on the underside of the engine cover.

According to a third aspect of the present invention there is provided an engine cover including at least one deflector member attached to or integrally formed with an underside of the cover.

Preferably, an outward facing surface of the deflector member is concave.

Preferably also, the deflector member extends the full length of the cover member.

Alternatively, the deflector member may comprise a number of deflector member portions each attached to or formed integrally with the underside of the cover member at positions generally above respective rocker arms.

According to a fourth aspect of the present invention, there is provided a rocker arm having an upwardly directed lubricant supply bore at a position intermediate its ends, wherein the bore communicates with a central bore through which, in use, a shaft for supporting the rocker arm for pivotal movement locates.

According to a fifth aspect of the present invention there is provided a rocker arm assembly support shaft having a longitudinally extending lubricant supply bore formed therein and at least one radially upwardly extending lubricant supply bore communicating therewith.

BRIEF DESCRIPTION OF THE DRAWINGS

The foregoing and further features of the present invention will be more readily understood from the following description of a preferred embodiment, by way to of example thereof, and with reference to the accompanying drawings, of which:

Referring to the drawings, FIG. 1 shows a partially exploded perspective view of a rocker arm assembly 10 in accordance with the present invention. The assembly 10 comprises a longitudinally extending support shaft 12 upon which are mounted rocker arms 14 at predetermined positions along the length of the shaft 12. Adjacent pairs of rocker arms 14 are separated by pedestal blocks 16 which each essentially comprise a split collar type clamp. One pedestal block 16 has a location screw 18 which screw-threadedly engages a threaded hole 20 in an upper half 16' of the pedestal block such that an end of the screw 18 locates in a counter-bore (not shown) in the shaft 12 to angularly and axially position the shaft with respect to the block. The holes 20 in the other blocks are utilised to secure the engine cover. The pedestal block also has a locking screw 22 which extends through a hole 24 in its upper half 16' to screw-threadedly engage a hole in its lower half 16" to enable the block 16 to be clamped upon the shaft 12. Between each pair of blocks are positioned two rocker arms 14, each of which abuts a respective block, and which are separated by a spring 26 mounted on the shaft therebetween.

Screws 28 retain the end rocker arms and also plug the shaft bore. The rocker arm assembly is mounted upon the cylinder head and secured by screws through the pedestal blocks.

Figure 1:
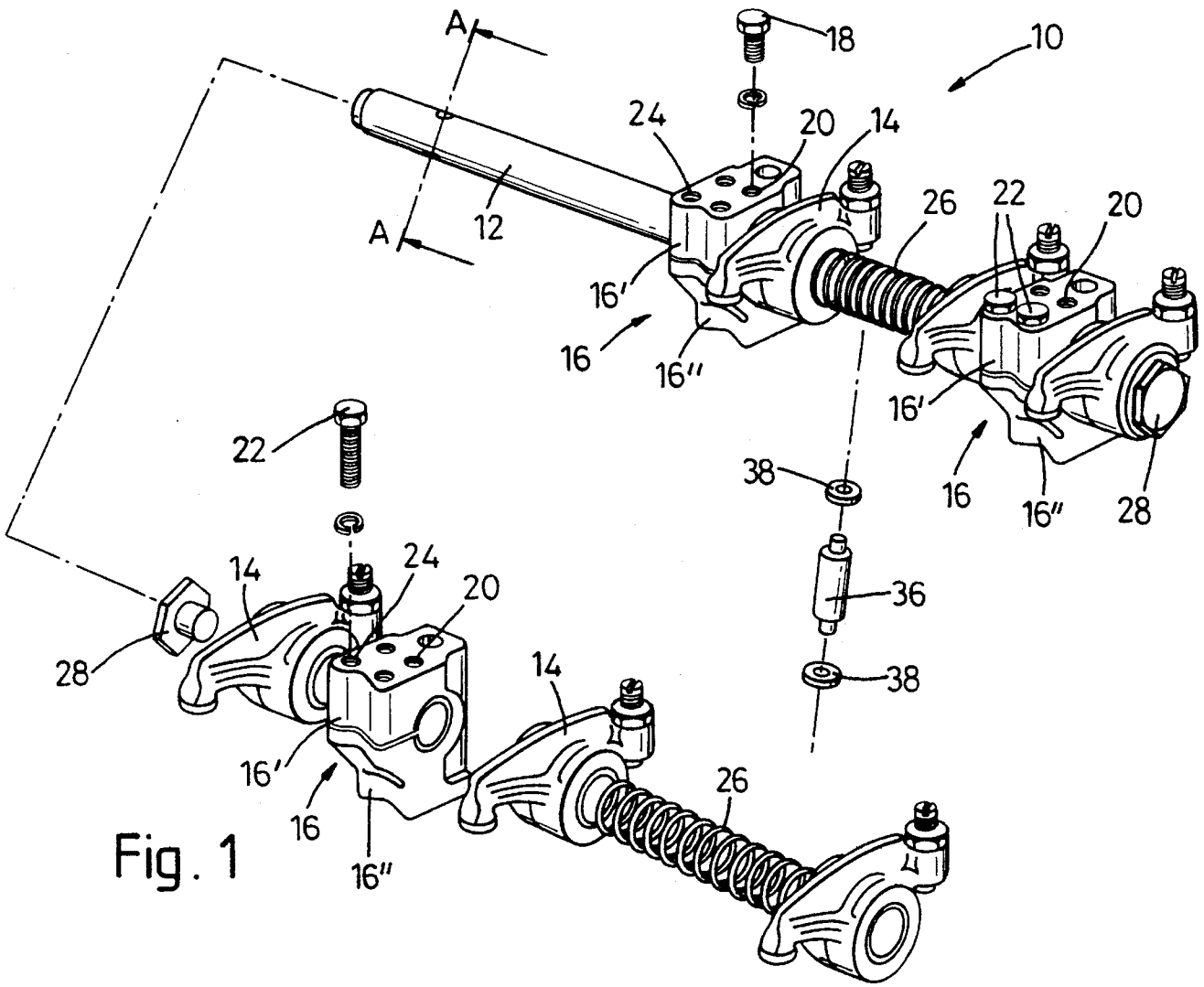
FIG. 1 is a partially exploded perspective view, to a smaller scale, of a rocker arm assembly in accordance with the present invention.
Figure 2:
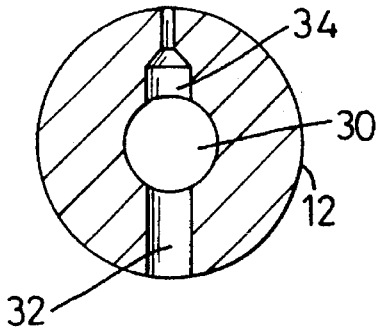
FIG. 2 is an enlarged sectional view along line A—A of FIG. 1.

The shaft 12 is formed with a longitudinally extending bore 30, which is better seen from the enlarged sectional view of FIG. 2. The longitudinally extending bore 30 of the shaft 12 extends the length of the shaft and communicates, for passage of lubricant, with a number of downwardly directed bores 32 and a number of upwardly directed bores 34, which will be explained in more detail later. In addition, a lubricant transfer means (FIG. 1) comprising a pipe member 36 and upper and lower sealing rings 38 locates in one of the downwardly directed bores 32 in order to supply engine lubricant under pressure to the bores (30,32,34) of the shaft 12.

Each of the rocker arms 14 is located at a position on the shaft 12 having a cross-section identical to that of FIG. 2.

Figure 3:
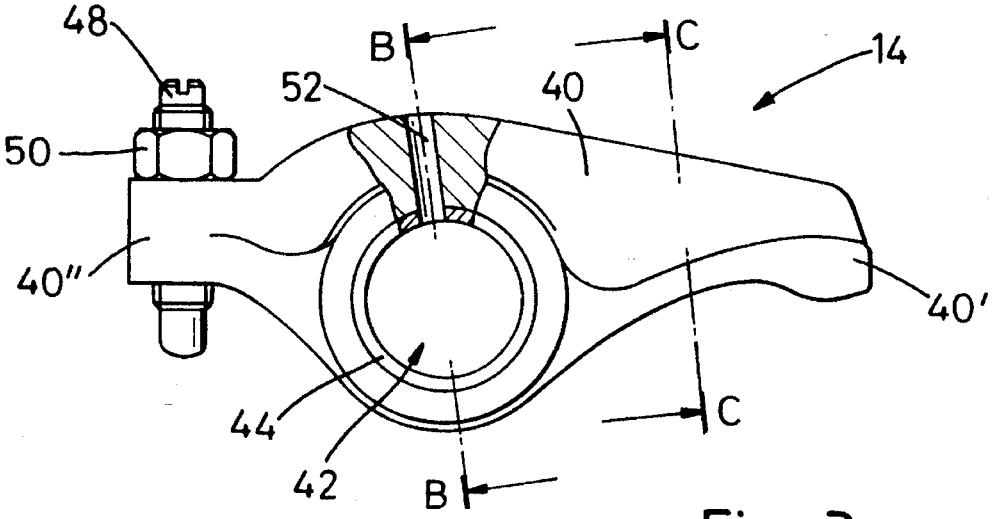
FIG. 3 is a side elevational view of a rocker arm in accordance with the present invention.
Figure 6:
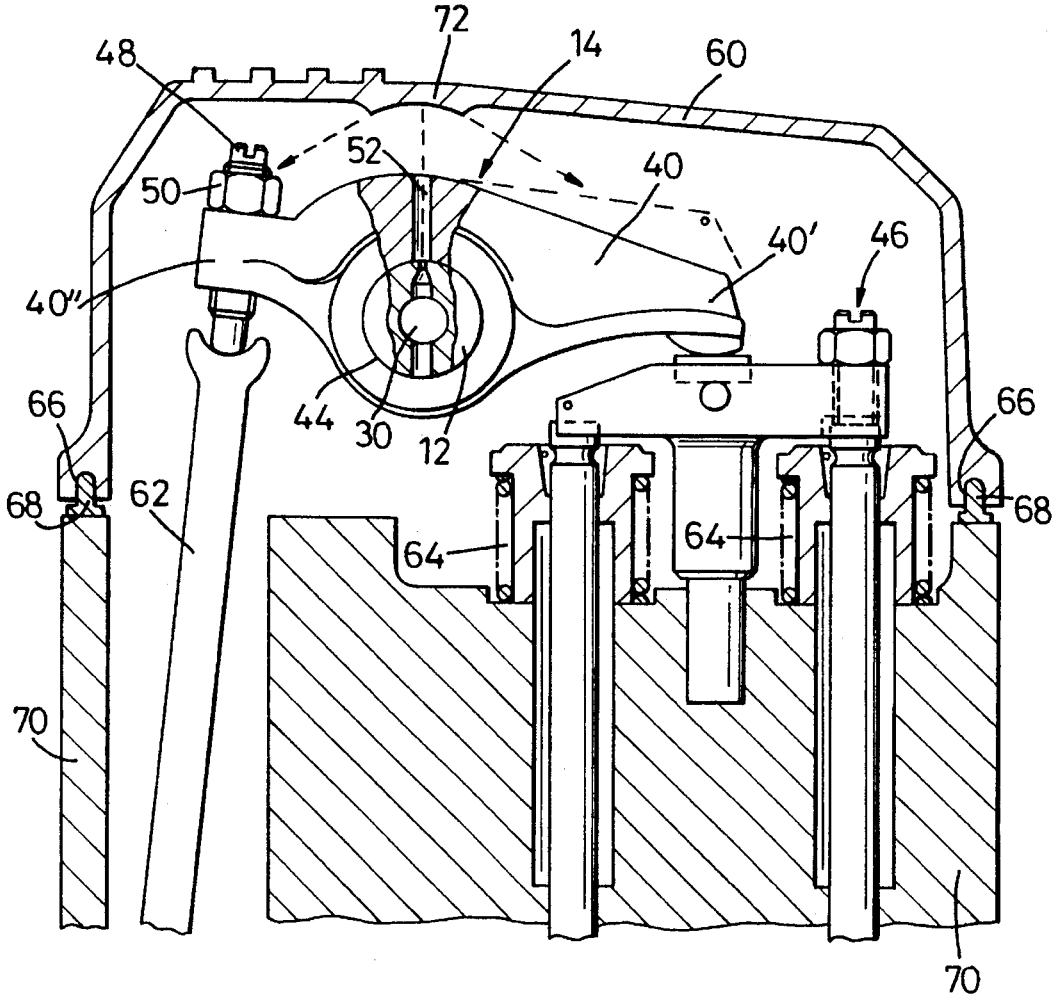
FIG. 6 is a side sectional view of an upper portion of an internal combustion engine illustrating a rocker arm lubrication arrangement in accordance with the present invention.

FIG. 3 is an enlarged side sectional view of a rocker arm 14. The rocker arm comprises a rocker arm body 40 having a central bore 42 into which a bush bearing 44 locates and through which, in use, the support shaft 12 locates for supporting the rocker arm 14 for pivotal movement thereabout. The rocker arm 14 also has a machined nose portion 40' which, in use, contacts with a valve stem assembly 46 (FIG. 6). An opposing end 40" of the rocker arm body 40 has an aperture through which an adjusting screw 48 extends, the adjusting screw being capped by a lock nut 50.

The rocker arm also has a generally upwardly directed bore 52 formed in a top portion of the body 40 wherein said bore 52 communicates with the central bore 42 of the body via an aperture 45 in the bush 44. In accordance with the present invention, it is important that the bush 44 is located into the central bore 42 of the rocker arm body 40 such that the aperture 45 in the bush is aligned with the upwardly directed bore in the body.

Figure 4:
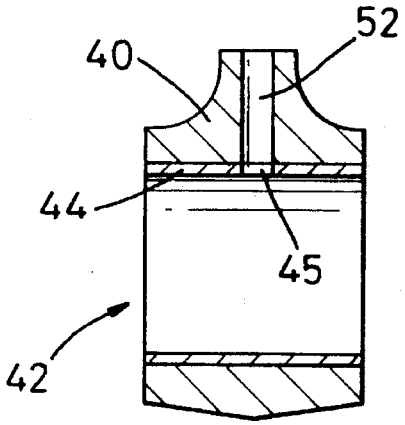
FIG. 4 is a sectional view along line B—B of FIG. 3.

FIG. 4 shows a section of the rocker arm 14 along line B—B of FIG. 3 illustrating more clearly the spatial relationship between the bore 52 in the rocker arm body 40 and the aperture 45 of the bush 44.

Figure 5:
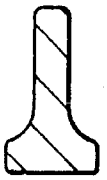
FIG. 5 is a sectional view, to a reduced scale, along line C—C of FIG. 3.

FIG. 5 is a reduced scale sectional view along line C—C of FIG. 3 illustrating the narrow dimensions of the nose portion 40' of the rocker arm body 40. It will be readily appreciated from this that to laterally drill a lubricant supply channel extending from an end of said nose portion to the central bore of the rocker arm body would be difficult, particularly in view of the relative narrowness of such a channel to its length and in view of the fact that the rocker arm body is normally cast or forged from metal. A previous solution to the problem of providing lubrication to the contact formed between the nose portion 40' and a valve stem assembly 46 has been to include such a channel but this resulted in the discarding of a significant proportion of machined rocker arms due to machining difficulties.

FIG. 6 is a side sectional view of an upper portion of an engine illustrating a rocker arm lubrication arrangement in accordance with the present invention. It can be seen from FIG. 6 that a rocker arm 14 is supported by a support shaft 12 at a position just below an engine cover 60 whereby a nose portion 40' of the rocker arm 14 contacts a valve stem assembly 46 whilst, at its other end, an adjusting screw bottom end contacts with a cup-shaped upper end of an engine push rod 62. In use, an upward movement of the push rod 62 causes pivotal movement of the rocker arm about the shaft 12 causing the nose portion 40' to act against the valve stem assembly 46 urging it against a return spring means 64 to a depressed position. As the push rod 62 drops, the valve stem assembly 46 is returned to its original position by the urging force of the compressed return spring means 64 and in turn this causes the rocker arm 14 to return to its original pivotal position relative to the support shaft as illustrated by the broken outline of the nose portion in the figure.

The rocker arm 14 shown is one of a number (not shown) supported on the shaft and enclosed by the engine cover 60. The engine cover 60 has a groove 66 around its periphery which sealingly fits upon a tongue member 68 attached to a periphery of a housing 70 for the engine. Lubrication of the ball joint formed between the lower end of the adjusting screw 48 and the upper end of the push rod 62 and of the contact between the nose portion 40' of the rocker arm body and valve stem assembly 46 can be by means of a lubricant mist generated in a lower region (not shown) of the engine whereby the rising mist coats the components of the engine lubricating their surfaces of contact. However, it has been found in some engines that the ball joints, in particular, may remain dry and this can lead to excessive wear of both the upper end of the push rods and lower ends of the adjusting screws requiring frequent adjustment or even replacement of parts.

Figure 7:
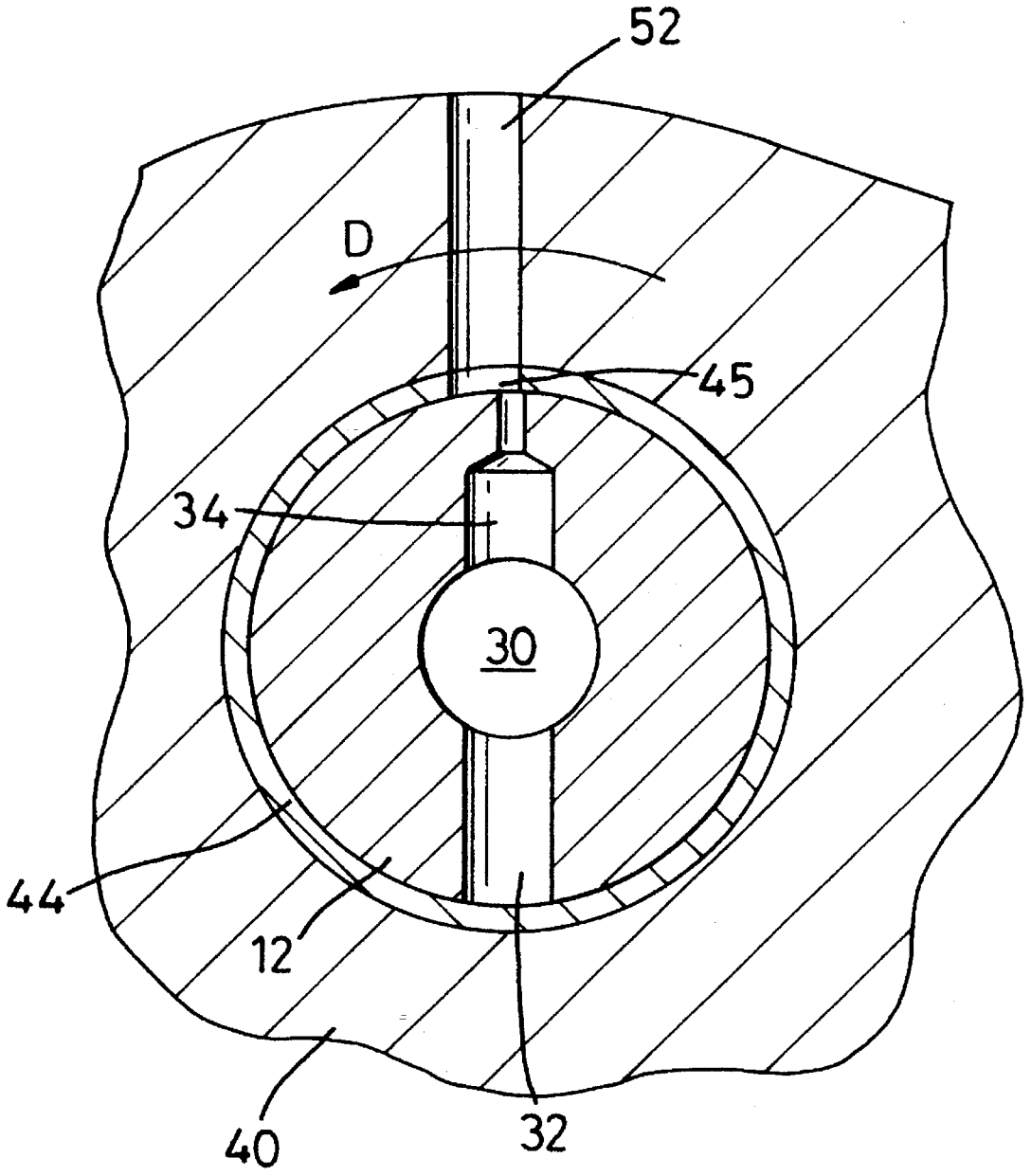
FIG. 7 is an enlarged view corresponding to the revealed portion of FIG. 1.

In order to overcome this problem, the rocker arms 14 are mounted upon the support shaft 12 such that their upwardly directed bores 52 can communicate with one of the upwardly directed bores 34 formed in the shaft 12. In fact, the upwardly directed bores 34 and downwardly directed bores 32 of the shaft 12 are generally formed in opposing pairs at positions along the shaft at which it is intended to locate a rocker arm 14. In use, the downwardly directed hole supplies lubricant in the form of engine oil to lubricate the contact between the rocker arm bush 44 (better seen in FIG. 7) and the shaft 12.

In use, oil is supplied to the longitudinally extending bore 30 of the shaft 12 and passes through an upwardly directed bore in said shaft to rise through a corresponding aperture in the rocker arm bush and an upwardly directed bore 52 in the rocker arm body 40. An upper portion of each of the upwardly directed bores of the support shaft 12 are formed of a narrower diameter. This can be achieved by a drilling process only or by firstly drilling a bore and then fitting a sleeve (not shown) within the bore. Oil supplied under engine oil pressure exits the upwardly directed bores as jets which, after rising through the rocker arm body 40, impinge upon an underside of the engine cover 60 to be returned back as a spray which lubricates the ball joints and nose portion/valve stem assembly contacts. However, it is preferable that the jets of oil exiting from the upwardly directed supply bores in the support shaft are not continuous since this can lead to a drop in engine oil pressure thus requiring a larger oil pump. In addition, by limiting the period of the oil jets, there is a reduction in the amount of oil required to be supplied to this part of the engine.

The above feature of the invention can be achieved by dimensioning the respective bores (34,52) in the support shaft 12 and rocker arm body 40 such that during a pivotal movement of the rocker arm said bores become radially displaced closing over the upwardly extending bores in the support shaft. This is better illustrated in FIG. 7 which shows an enlarged view of the revealed portion FIG. 6 illustrating the relative rotated position of the rocker arm body 40 to the shaft 12 at a point where further rotation of the rocker arm body 40 in the direction of arrow D will cause the upwardly directed bore 34 of the shaft 12 to be closed off.

Pivotal movement of the rocker arms 14 relates directly to the reciprocal motion of the push rod 62 which takes its motion from the engine camshaft (not shown) which in turn relates to crankshaft rotation. It is envisaged that the relative dimension of the bores in the rocker arm bodies to the upwardly directed bores in the support shaft should be such that the period of each oil jet relates to 45° of crankshaft rotation. It is believed that this is suitable to provide sufficient lubrication of the rocker arm assembly contacts. However, it will be appreciated that these dimensions can be varied to provide different timed periods for the oil jets.

The jets of oil impinge upon an underside of the engine cover 60 to be returned as a spray for lubricating the rocker arm assembly components. To assist the pattern of spray, there is provided a deflector member 72 on the underside of the engine cover 60 against which the jets of oil impinge. The shape of the deflector member 72 is such that it controls the spread of spray, as illustrated in broken outline in FIG. 6, to that best suited to the dimensions of the rocker arms 14. In one particular embodiment, this member 72 has a convave outer or lower surface but it is envisaged that different shapes might suit different dimensional considerations. The deflector member 72 may extend along the underside of the engine cover for a length corresponding to the span between the outermost rocker arms 14. Alternatively, the deflector member may be formed of a number of portions positioned at appropriate points on the underside of the cover member for deflecting the respective jets of oil exiting from the rocker arms 14.

I claim:

1. A rocker arm lubrication arrangement comprising a rocker arm assembly comprising a number of rocker arms mounted for pivotal movement about a longitudinally extending support shaft formed with a longitudinally extending lubricant supply bore and a number of radially substantially vertically extending lubricant supply bores communicating therewith, wherein at least one of said radially substantially vertically extending bores at least selectively communicates with an upwardly extending lubricant supply bore in a corresponding one of said rocker arms such that lubricant passing under pressure through said longitudinally extending supply bore to said radially substantially vertically extending supply bore forms a jet of lubricant which rises substantially vertically through said corresponding bore in the rocker arm to impinge upon an underside of an engine cover and to be returned as a spray to lubricate contact points between opposed ends of the rocker arm and at least two other engine components located adjacent the opposed ends of the rocker arm.

2. A rocker arm lubrication arrangement as claimed in claim 1, wherein each radially substantially vertically extending supply bore in the support shaft has a portion of narrower diameter than the longitudinally extending supply bore.

3. A rocker arm lubrication arrangement as claimed in claim 1, wherein at least one deflector member is located on the underside of the engine cover and serves to direct said spray.

4. A rocker arm lubrication arrangement as claimed in claim 1, wherein pivotal movement of the rocker arm causes the rocker arm supply bores to become radially displaced relative to their respective radially extending supply bores to the extent of cutting off of lubricant flow for a portion of a period of oscillation of pivotal movement of said rocker arm.

5. A rocker arm lubrication arrangement as defined in claim 1, wherein the engine components comprise (1) a valve and (2) a ball joint of a push rod assembly.

6. A rocker arm lubrication arrangement as defined in claim 2, wherein an upper portion of each of the substantially vertically extending lubricant supply bores in the rocker arm support shaft is of a relatively narrow diameter when compared to the remainder of the substantially vertically extending lubricant supply bore.

7. A system comprising:

(A) an internal combustion engine;

(B) a shaft which extends longitudinally of said engine and which has formed therein (1) a first, longitudinal lubricant supply bore, and (2) a second lubricant supply bore extending radially and substantially vertically though said shaft from said first supply bore to an outer periphery of said shaft, said second lubricant supply bore being restricted at an upper end thereof;

(C) a valve spaced from a first side of said shaft;

(D) a push rod assembly spaced from a second side of said shaft and including a ball joint;

(E) a rocker arm pivotally mounted on said shaft, said rocker arm (1) having a third lubricant supply bore formed therein and selectively cooperating with said second lubricant supply bore, said third lubricant supply bore being the only lubricant supply bore formed in said rocker arm and cooperating with said second lubricant supply bore only when said third lubricant supply bore extends at least generally vertically, and (2) having a first end which contacts a mating portion of said valve and a second end which is connected to said ball joint of said push rod assembly; and (F) an engine cover which is disposed above said rocker arm and on an underside of which is provided deflector means, located at least generally vertically above said shaft, for receiving a jet of lubricating fluid rising out of said third lubricant supply bore and for returning said lubricating fluid as a spray which lubricates the ends of said rocker arm, said valve, and said ball joint.

8. An engine cover comprising: a deflector member which is located on an underside of said cover, said deflector member being dimensioned and configured to receive a jet of lubricating fluid rising out of a lubricant supply bore formed in a rocker arm and to return said lubricating fluid as a spray which lubricates (1) a first end of said rocker arm and a mating portion of a first associated engine component and (2) a second end of said rocker arm and a mating portion of a second associated engine component.

9. An engine cover as claimed in claim 8, wherein a downward facing surface of the deflector member is concave.

10. A method of lubricating a rocker arm assembly comprising:

providing an internal combustion engine comprising a rocker arm support shaft, a rocker arm pivotally mounted on the rocker arm support shaft and having opposed ends, first and second engine components located adjacent the opposed ends of the rocker arm, and an engine cover located above the rocker arm support shaft, the rocker arm, and the first and second engine components;

supplying lubricant under pressure along a longitudinally extending bore formed in the rocker arm support shaft; then diverting the lubricant upwardly through an upwardly directed bore in the shaft and a corresponding bore in the rocker arm, thereby to form a lubricant jet; then impinging said lubricant jet on a member located above the shaft, thereby to form a lubricant spray; and then lubricating the first and second engine components with the lubricant spray.

11. A method as defined in claim 10, wherein the method includes the step of directing the jet such that it impinges on a deflector member located on an underside of the engine cover.

12. A method as defined in claim 10, wherein the diverting step comprises first forcing the lubricant through a lower portion of the bore in the shaft and then forcing the lubricant through an upper portion of the bore in the shaft, the upper portion having a diameter which is relatively small when compared to the diameter of the lower portion thereof.

13. A system comprising:

(A) an internal combustion engine;

(B) a shaft which extends longitudinally of said engine and which has formed therein (1) a longitudinal lubricant supply bore, and (2) a plurality of upwardly extending radial lubricant supply bores communicating with said longitudinal supply bore;

(C) a plurality of rocker arms pivotally mounted on said shaft, each of said rocker arms (1) having an upwardly extending lubricant supply bore formed therein cooperating with a respective one of said radial supply bores in said shaft, and (2) having a first end which contacts a mating portion of a first engine component and a second end which contacts a mating portion of a second engine component; and (D) an engine cover which is disposed above said rocker arms and on an underside of which is provided means, located above at least one of said rocker arms, for receiving a jet of lubricating fluid rising out of the supply bore in said at least one of said rocker arms and for returning said lubricating fluid as a spray which lubricates the ends of said at least one rocker arm and the mating portions of the first and second engine components.

14. A rocker arm lubrication arrangement as defined in claim 13, wherein each of the supply bores in said shaft has an upper portion which is of a relatively narrow diameter when compared to a diameter of remainder of the supply bore.

15. A system as claimed in claim 13, wherein said means for receiving and returning includes a deflector member which is located on said underside of said cover.

16. A system as claimed in claim 15, wherein said deflector member has a concave downwardly facing surface which receives said lubricating fluid jet.

17. A system as claimed in claim 13, wherein said supply bores in the rocker arms cooperate with said radial supply bores in said shaft such that said radial supply bores in said shaft open into said supply bores in said rocker arms only at designated angular positions of said rocker arms with respect to said shaft and are otherwise closed by said rocker arms.

18. A method of lubricating a first contact point between a first end of a rocker arm and a first engine component and a second contact point between a second end of said rocker arm and a second engine component, said method comprising:

(A) supplying a pressurized lubricating fluid to a longitudinal supply bore formed in a shaft on which said rocker arm is pivotally mounted; then (B) discharging a jet of said lubricating fluid from said longitudinal supply bore, through an upwardly extending radial supply bore formed in said shaft, and through an upwardly extending supply bore formed in said rocker arm; then (C) impinging said jet of said lubricating fluid on a deflector member located on an engine cover above said rocker arm, thereby forming a spray of said lubricating fluid; and then (D) returning said spray of said lubricating fluid to said first and second contact points, thereby lubricating said first and second contact points.

19. A method as claimed in claim 18, wherein said impinging step comprises impinging said jet of said lubricating fluid on said deflector member which is located on an underside of said engine cover.

20. A method as claimed in claim 18, wherein said discharging step takes place only intermittently and comprises permitting fluid flow into said supply bore in said rocker arm from said radial supply bore in said shaft only at designated angular positions of said rocker arm with respect to said shaft and otherwise prohibiting said fluid flow.

21. A method as defined in claim 18, wherein the discharging step comprises forcing the lubricant through a lower portion of the bore in said shaft and then forcing the lubricant through an upper portion of the bore in said shaft, the upper portion having a diameter which is relatively small when compared to the diameter of the lower portion.

* * * * *